US006831543B2

(12) United States Patent
Mizoguchi et al.

(10) Patent No.: US 6,831,543 B2
(45) Date of Patent: Dec. 14, 2004

(54) SURFACE MOUNTING TYPE PLANAR MAGNETIC DEVICE AND PRODUCTION METHOD THEREOF

(75) Inventors: Tetsuhiko Mizoguchi, Yokohama (JP); Tetsuo Inoue, Yokohama (JP); Shigeru Yatabe, Komae (JP); Yasutaka Fukuda, Chiba (JP); Yoshihito Tachi, Taito (JP)

(73) Assignees: Kawatetsu Mining Co., Ltd., Tokyo; Kabushiki Kaisha Toshiba, Kawasaki ( * ) Notice: Subject to any disclaimer, the term of this patent is extended or adjusted under 35 U.S.C. 154(b) by 166 days.

(21) Appl. No.: 09/790,625

(22) Filed: Feb. 23, 2001

(65) Prior Publication Data

US 2001/0024739 A1 Sep. 27, 2001

(30) Foreign Application Priority Data

Feb. 28, 2000 (JP) ..... 2000-050796

(51) Int. Cl.[7] ..... H01F 5/00
(52) U.S. Cl. ..... 336/200; 336/232; 336/223
(58) Field of Search ..... 336/200, 223, 336/232, 192, 198, 208; 29/602.1, 606, 607

(56) References Cited

U.S. PATENT DOCUMENTS

| | | | | | |
|---|---|---|---|---|---|
| 4,987,009 | A | | 1/1991 | Nakamura et al. | |
| 5,302,932 | A | * | 4/1994 | Person et al. | 336/200 |
| 5,312,674 | A | * | 5/1994 | Haertling et al. | 428/210 |
| 5,532,667 | A | * | 7/1996 | Haertling et al. | 336/177 |
| 5,598,136 | A | * | 1/1997 | Kano et al. | 336/200 |
| 5,738,931 | A | | 4/1998 | Sato et al. | |
| 6,107,907 | A | * | 8/2000 | Leigh et al. | 336/200 |
| 6,136,458 | A | | 10/2000 | Inoue | |
| 6,448,879 | B1 | * | 9/2002 | Kitamura | 336/200 |
| 6,456,183 | B1 | * | 9/2002 | Basteres et al. | 336/200 |

FOREIGN PATENT DOCUMENTS

| | | |
|---|---|---|
| JP | 4-363006 A | 12/1992 |
| JP | A 6-77055 | 3/1994 |
| JP | A 9-134820 | 5/1997 |
| JP | A 11-26239 | 1/1999 |
| JP | 11-31632 A | 2/1999 |

OTHER PUBLICATIONS

Journal of Magnetic Society of Japan 20 (1996), pp. 922–924.

* cited by examiner

*Primary Examiner*—Anh Mai
(74) *Attorney, Agent, or Firm*—Oliff & Berridge, PLC

(57) ABSTRACT

A surface mounting type planar magnetic device comprised of upper ferrite magnetic film, lower ferrite magnetic film and a planar coil interposed therebetween. For applying surface mount technology, an opening is formed in the upper ferrite magnetic film above a coil terminal portion and then, an external electrode conductive with the coil terminal portion through the opening is formed on the upper ferrite magnetic film. Further, this surface mounting type planar magnetic device is of a thin structure and can be mounted on the surface of a printed board. Its power loss is small, its inductance is large, its frequency characteristic is excellent, the disparity of the characteristic is small and its reliability is excellent.

32 Claims, 10 Drawing Sheets

SURFACE MOUNTING TYPE PLANAR MAGNETIC DEVICE AND PRODUCTION METHOD THEREOF

BACKGROUND OF THE INVENTION

1. Field of the Invention

The present invention relates to a surface mounting type planar magnetic device and production method thereof.

2. Description of the Related Art

In recent years, use of portable apparatuses driven by battery such as mobile phone and notebook-type personal computer has been accelerated. Since before, reduction of the weight and size of such portable apparatuses has been demanded and in addition to this demand, recently, higher functions such as communication function, display function and high-speed processing function for a large amount of information including image data have been also requested. Correspondingly, a demand for a power supply capable of transforming a single voltage from a battery to voltage levels necessary for various mounted devices such as CPU, LCD module, and communication power amplifier has been increased. Thus, to achieve the higher function as well as reduction of the size and weight, it has been an important theme to accelerate reductions of the size and thickness of such a magnetic device as transformer and inductor and the like to be mounted on the power supply.

Under this condition, a transformer or an inductor composed of sintered ferrite wound with coil is loaded on the conventional small portable apparatus. However, these components are difficult to thin thereby obstructing thinning of a power supply unit. A planar inductor composed of metal magnetic film layer, insulating layer, planar coil layer, insulating layer and metallic magnetic film layer on Si substrate in order to reduce the size and weight thereof has been described in Journal of the Magnetic Society of Japan 20(1996), pp. 922–924 and disclosed in Japanese Patent Application Laid-Open No. 4-363006. However, these conventional planar inductors have problems in terms of production cost and characteristic. That is, because metal magnetic film of 6 to 7 $\mu$m is formed by spattering method and an insulating layer needs to be formed between the metal magnetic film and the planar coil, production cost for the planar inductor is sure to rise with respect to the conventional magnetic device.

The problems in terms of the characteristic are as follows. Because the planar inductor is driven by high frequency in MHz band, power loss is increased by generation of eddy current inside metal magnetic film which is electrically conductive. As for another characteristic problem, because upper and lower metal magnetic layers oppose each other through a slight nonmagnetic space, vertical alternate magnetic flux intersects the planar coil, so that eddy current is generated thereby increasing power loss. For the former, it has been proposed to divide the eddy current to small parts by forming a high resistance region on the same plane as the metal magnetic film according to Japanese Patent Application Laid-Open No. 6-77055 and for the latter, it has been proposed to divide the planar coil conductor to small parts according to Japanese Patent Application Laid-Open No. 9-134820 in order to improve the characteristics. However, it cannot be said that the characteristics have been improved sufficiently.

To solve these problems, Japanese Patent Application Laid-Open No. 11-26239 has disclosed a planar magnetic device employing a ferrite magnetic film formed by printing method or sheet method instead of the metal magnetic film. According to this method, magnetic paste produced by mixing binder with ferrite powder is printed on Si substrate and baked so as to produce a high resistance ferrite magnetic film. After a coil pattern is formed on this film by the plating method, ferrite magnetic film is formed thereon so as to produce a magnetic device. However, this publication has not disclosed an external electrode which is a feature of the present invention, and further surface mount technology (SMT) cannot be applied.

SUMMARY OF THE INVENTION

According to the conventional technology, because wire bonding method is employed to connect wires to a wired substrate, surface mount technology (SMT) cannot be applied, thereby leading to increase of production cost. The present invention intends to eliminate defects of the conventional technology and provide a surface mounting type magnetic device which achieves excellent characteristics at low cost. Concrete subjects of the present invention are as follows.

(a) Planar magnetic device capable of being thinned and mounted on the surface of a printed board (b) Planar magnetic device having small power loss and large inductance (c) Excellent frequency characteristic, small disparity of the characteristic and excellent reliability The inventors had considered means for solving the above described problems sincerely and finally, completed the present invention by employing the following means. The concrete means will be described in details separately. These means are effective even if they are used independently and further a more conspicuous effect can be obtained by combining two or more means.

According to a first embodiment of the present invention, there is provided a surface mounting type planar magnetic device comprised of upper ferrite magnetic film, lower ferrite magnetic film and a planar coil interposed therebetween, in which an opening is formed in the upper ferrite magnetic film above the planar coil terminal portion and an external electrode conductive with the coil terminal portion through the opening is formed on the upper ferrite magnetic film.

The conventional planar magnetic device has a substrate for supporting the magnetic film and coil, which occupy most thickness of the device. According to the present invention, by composing the structure of the planar magnetic device with lower ferrite magnetic film, planar coil, upper ferrite magnetic film and external electrode while removing the substrate, the planar magnetic device can be thinned further. Further, because an external electrode is provided, the surface mount technology can be applied. An example of production of a magnetic device free of the substrate (substrate free magnetic device) will be described. This is just an example and the present invention is not restricted to this example. Lower ferrite magnetic film containing Cu is formed on a Si substrate and consequently, a planar coil, upper ferrite magnetic film and external electrode are formed. After that, if this is left under constant temperature and humidity of 90° C., 95% RH (Relative Humidity) for more than 10 hours, for example, the ferrite magnetic film and substrate can be separated through an interface therebetween, so that the substrate free magnetic device can be obtained. If there occurs a trouble of handling upon actual use because it is too thin, this can be formed as a substrate provided magnetic device like conventionally and by adding an external electrode to this, the surface mounting type magnetic device may be produced.

According to a second embodiment of the present invention, there is provided a surface mounting type planar magnetic device wherein a lower ferrite magnetic film is formed on a substrate; a planar coil is formed on the lower ferrite magnetic film; an upper ferrite magnetic film having an opening above a terminal portion of the planar coil is formed; and an external electrode conductive with the planar coil terminal portion is formed. In this case, any substrate material can be used if it achieves a function as a supporting body. It is more preferable to use Si substrate or $Al_2O_3$ (alumina) substrate which are used in semiconductor industry in terms of cost performance.

In the surface mounting type planar magnetic device of the present invention, preferably, the planar coil is a spiral coil or a combination of plural spiral coils connected in series. Further, the planar coil is preferred to be composed of Cu conductor. The reasons will be described below.

Although for example, spiral type, meander type and the like can be employed for the planar coil, the spiral type is preferable because it is capable of achieving a larger inductance. Further, by arranging two or more spiral type coils in series such that they are connected, it is possible to obtain an inductance larger than times the inductance of a single coil by the number of the coils.

If the planar magnetic device is used as a chalk coil for the DC/DC converter, power loss Pi of the inductor is expressed in a following expression (1).

$$Pi = Rdc\left(I_{dc}^2 + \frac{I_p^2}{3}\right) + Rm\frac{I_p^2}{3} \tag{1}$$

where

Rdc: DC resistance of coil

Rm: equivalent resistance of magnetic substance

Idc: DC current

Ip: peak current of triangular wave

Therefore, to reduce power loss of the inductor, it is preferable to decrease coil DC resistance Rdc, that is, use coil material having a small resistivity. Such material includes Ag ($1.47\times10^{-6}$ Ωcm), Cu ($1.55\times10^{-6}$ Ωcm), and Ni ($6.2\times10^{-6}$ Ωcm). Although copper sulfate plating bath is employed for Cu, silver cyanide plating bath is employed for Ag, providing with a poor work efficiency. Further, Ag needs higher cost than Cu and has a problem in migration. The baking temperature of the upper ferrite magnetic film needs to be reduced because the melting point of Ag is 962° C., which is lower than that of Cu of 1085° C. Ni has a high risistivity. From standpoints of production and work efficiency, the Cu planar coil is preferred by the planar inductor employing the ferrite magnetic film.

Next, preferably, the planar coil is made of Cu conductor formed by electro plating with two-layer films, comprised of a film composed of a metal selected from a group of Nb, Ta, Mo, and W or an alloy composed of two or more of these metals formed by dry process such as spattering method and Cu film as plating foundation. The method for forming the Cu coil includes electro plating method, electroless deposition, printing/baking method and the like. Although the printing/baking method is often employed for chip inductor used for signal, this method has a problem that the resistivity is deteriorated because of mixture of binder component and incomplete baking. The electroless deposition method has a slower deposition speed than electro plating so that productivity is low and further, B or P is mixed from reducing agent, thereby increasing resistivity largely. On the other hand, the electro plating method has a high productivity and can obtain pure metal so that its resistivity is the smallest. Therefore, the Cu conductor coil formed by the electro plating method is more preferable for the magnetic device of the present invention. When the planar coil is formed by electro plating, a plating foundation is required as an electrode, because the ferrite magnetic film is electrically an insulator. As a result of accumulated considerations of plating foundation material from viewpoint of adhesion to the ferrite magnetic film and planar coil, it is found preferable to employ two-layer films composed of a film formed of a metal selected from elements such as Nb, Ta, Mo and W or an alloy composed of two or more of these metals and Cu film having an excellent adhesion with the planar coil. As for the layered film, the film formed of a metal selected from elements such as Nb, Ta, Mo and W or an alloy composed of two or more of these metals is disposed on the side of the lower ferrite magnetic film, while the Cu film is disposed on the side of the upper ferrite magnetic film.

Next, the sectional shape of the planar coil will be described. When the section of the planar coil is trapezoidal and it is assumed that the side contacting the lower ferrite magnetic film is a lower bottom and the side contacting the upper ferrite magnetic film is a upper bottom, according to the present invention, it is defined that lower bottom≧upper bottom is forward taper while lower bottom<upper bottom is inverse taper. The forward taper includes a rectangular section composed of vertical sides. The section of the planar coil for the magnetic device of the present invention is preferred to be of forward taper. In case of the inverse taper, there is generated a problem in adhesion because a contact area with the lower ferrite layer is small and upon production, upper ferrite paste is not fed around the planar coil well, so that a gap is generated between the coil and ferrite magnetic film, thereby producing problem on production such as increased disparity of inductance. Because these problems can be solved by employing the forward taper for the section of the planar coil, the section of the planar coil is preferred to be of forward taper.

The thickness of the planar coil is 10 μm or more to 100 μm or less. To reduce loss by DC resistance of the coil, it is effective to enlarge a sectional area of the coil as well as reduce resistivity of coil material as described above. At this time, if the coil thickness is decreased, the coil width is increased. AC resistance R(f) of a N-turn coil under frequency f is expressed in the expression (2).

$$R(f) = Rdc\left[1 + \frac{4\pi^2 f^2 tcd^4}{12\rho^2}\cdot\frac{\sum(Bk^2 lk)}{\sum lk}\right] \tag{2}$$

where:

Rdc: DC resistance of coil tc: coil thickness d: coil line width

ρ: resistivity of coil

Bk: effective value of vertical alternate magnetic flux of k-th coil line lk: length of k-th coil line Therefore, it is evident that increase of the coil line width d is not preferable because it induces increase of coil loss due to vertical alternate magnetic field. Further, increase of the coil line width d is not preferred because it increases inductor dimensions (occupied area of device). For the above reasons, the lower limit of planar coil thickness tc is set to 10 μm. Stray capacitance C exists in the magnetic device due to coil(=electrode)/ferrite magnetic film (=dielectric material) of coil structure and resonates with inductance L thereby deteriorating frequency characteristic. The resonant frequency fr is expressed in the expression (3).

$$fr=1/(2\pi\sqrt{LC}) \quad (3)$$

where

L: inductance

C: stray capacitance

To obtain an appropriate resonant frequency fr, the stray capacitance C has to be minimized. The stray capacitance C is proportional to electrode area and inversely proportional to a distance between electrodes. Because the stray capacitance C is increased if the coil thickness is increased, the coil interval may be increased correspondingly. However, there occurs a new problem such as magnetic field ripple in magnetic film. Considering all these matters, the upper limit of the thickness tc of the planar coil is determined to be 100 μm.

Next, according to the present invention, preferably, insulating coating film composed of $SiN_x$ ($1 \leqq x \leqq 1.5$), $AlN_y$ ($0.8 \leqq y \leqq 1.2$), $Al_2O_3$ or multiple layers thereof having a thickness of 0.1 μtm or more to 10 μm or less is formed on the surface of the planar coil excluding a top face of the terminal portion in order to suppress mixture of oxygen from outside. In the upper ferrite magnetic film baking process, oxidation of the planar coil is prevented in order to prevent loss of inductor due to increase of coil resistance. As a result of accumulated considerations, it is found preferable to form coating film composed of $SiN_x$ ($1 \leqq x \leqq 1.5$), $AlN_x$ ($0.8 \leqq x \leqq 1.2$), $Al_2O_3$ or multiple layers thereof having a thickness of 0.1 μm or more to 10 μm or less so as to prevent mixture of oxygen into the surface of the planar coil. At this time, if the thickness of the coating film is 0.1 μm or more, diffusion of oxygen to the Cu coil can be prevented. However, if the thickness exceeds 10 μm, separation of the coating film occurs and a non-magnetic gap is generated between the coating film and the upper ferrite magnetic film. As a result, reduction of inductance, increase of loss accompanied by an increase of vertical alternate magnetic field intersecting the coil and the like occur. Therefore, the thickness of the coating film is preferred to be 0.1 μm to 10 μm.

Next, the composition of the ferrite magnetic film will be described. Preferably, the average composition of the ferrite magnetic film is $Fe_2O_3$: 40 to 50 mol %, ZnO: 15 to 35 mol %, CuO: 0 to 20 mol %, $Bi_2O_3$: 0 to 10 mol % while remainder is NiO or unavoidable impurity. This composition is average values for the entire magnetic device and it is permissible to select an optimum composition for the upper ferrite magnetic film, lower ferrite magnetic film, ferrite/substrate interface and the like, depending on a target position. The reason why the composition of the magnetic film is limited is as follows.

$Fe_2O_3$: 40 to 50 mol %

If $Fe_2O_3$ exceeds 50 mol %, electric resistance drops rapidly due to existence of $Fe^{2+}$ ion. Reduction of electric resistance increases loss in the ferrite core rapidly due to eddy current which is generated when used in high frequency region. $Fe_2O_3$ is set to 40 to 50 mol % because deterioration of inductance is increased accompanied by drop of permeability of the ferrite magnetic film when $Fe_2O_3$ is less than 40 mol %.

ZnO: 15 to 35 mol %

ZnO affects inductance and Curie temperature largely. The Curie temperature is an important parameter which determines heat resisting property of the magnetic device. Although the Curie temperature is high when ZnO is less than 15 mol %, inductance drops. On the other hand, if ZnO exceeds 35 mol %, the Curie temperature Tc drops although inductance is high. Therefore, ZnO is preferred to be limited to 15 to 30 mol %.

CuO: 0 to 20 mol %

CuO is added to lower the baking temperature. Although the baking temperature drops if CuO exceeds 20 mol %, inductance deteriorates. Thus, the upper limit of CuO is set to 20 mol %.

$Bi_2O_3$: 0 to 10 mol %

$Bi_2O_3$ has an effect of reducing the baking temperature like CuO. If it exceeds 10 mol %, inductance deteriorates although the baking temperature drops. Therefore, the upper limit is set to 10 mol %.

Next, the thickness of the aforementioned lower ferrite magnetic film will be described. Inductance of the magnetic device depends on μr×tm and μr×tm≧1000 (μm) is required. where μr is relative permeability and tm is film thickness. Considering that the permeability of the ferrite magnetic film in the magnetic device is 100–200, the film thickness needs to be 10 μm or more. On the other hand, if the thickness of the lower ferrite magnetic film exceeds 100 μm, inductance is increased. However, the film thickness is increased so that defects such as separation of the ferrite magnetic film often occur. Therefore, preferably, the thickness of the lower ferrite magnetic film is 10 μm or more to 100 μm or less.

Next, in the surface mounting type planar magnetic device having a substrate of the present invention, the concentration of CuO in a layer contacting the substrate in the lower ferrite magnetic film is 5 mol % or less and the concentration of CuO in other portions is more than 5 mol %. In case where the substrate of the lower ferrite magnetic film is Si, if a large amount of Cu is contained in the ferrite magnetic film, adhesion performance may drop. As a result of accumulated considerations on a way for solving this problem, it was found that a phase rich in Si—Cu deposited on ferrite/substrate interface reduced the adhesion performance and by suppressing this deposition amount, the reduction of the adhesion performance could be solved. That is, by reducing the concentration of CuO in the ferrite layer near the interface in contact with the Si substrate to less than 5 mol %, deposition on the phase rich in Si—Cu can be suppressed largely, thereby improving adhesion with the Si substrate. Baking at a reduced baking temperature with the concentration of CuO in the lower ferrite composition excluding near the ferrite/substrate interface is more preferable from viewpoints of prevention of warp of the substrate. An example of the method for achieving the lower ferrite film having such a structure will be described. A lower ferrite magnetic film of 5 mol % or less in concentration of CuO is formed on the Si substrate and the film thickness is several μm after baking. Subsequently, ferrite magnetic film of more than 5 mol % in concentration of CuO is formed in a required thickness. At this time, although the two-layer ferrite magnetic films may be baked at the same time or separately (optimum baking temperature for each layer) twice, higher adhesion performance can be obtained if the baking is carried out separately. The above described matter is just an example and the present invention is not restricted to this.

Next, the lower ferrite magnetic film formed on the substrate is baked together with the substrate at 900° C. to 1250° C., it is cooled down to room temperature. If Si is employed for the substrate, a warp occurs in the substrate/lower ferrite magnetic film composite material because the thermal expansion of the ferrite magnetic film is $9–10\times10^{-6}$/K although the thermal expansion of the substrate is $2.4\times10^{-6}$/K. As a result, a trouble may occur in post process such as planar coil production step. This problem can be solved by introducing cracks into the ferrite magnetic film positively so as to reduce an area surrounded by the cracks. In the ferrite magnetic film for the magnetic device formed on the substrate, preferably, a number of cracks are formed at least on the surface of ferrite magnetic film on an opposite side not in contact with the substrate and an average of diameters of circles converted from the areas surrounded by the cracks is less than 100 $\mu$m. Meanwhile, if a crack is produced in the ferrite magnetic film, the crack reaches an edge of the film. If it is intended to just restore the warp, this can be also achieved by introducing several cracks. However, if the crack interval is large so that the area surrounded by the cracks is increased, leaking magnetic flux is generated, thereby producing new problems such as reduction of inductance by diamagnetic field and separation of the ferrite magnetic film. For the reason, the number of cracks is increased so as to reduce each area surrounded by the cracks. Consequently, distortion generated in the ferrite magnetic film is released so that the aforementioned problem never occurs. The area of a portion surrounded by the cracks is expressed by equivalent diameter. The equivalent diameter refers to the diameter of a circle converted from the area of a portion surrounded by the cracks. If the average of the equivalent diameter of each portion surrounded by the cracks exceeds 100 $\mu$m, the aforementioned leaking magnetic flux occurs or the ferrite magnetic film becomes likely to be separated. Therefore, the upper limit is set to 100 $\mu$m or less. Meanwhile, the depth of the crack may be only in the surface of the film or may reach the surface of the substrate. Although a method for generating such a crack is not restricted to any particular one, but the crack may be generated by reducing the baking temperature to a temperature lower than usually, for example, not more than 920° C. or increasing the cooling velocity so as to be higher than 5° C. per minute. Further, it is permissible to add additional material for reducing grain boundary strength, for example, $V_2O_5$, $In_2O_3$ into film so as to reduce mechanical strength of the film.

An opening is made in the planar coil terminal portion of the upper ferrite magnetic film so as to be conductive with an external electrode, in order to prevent a conductor portion following the planar coil terminal portion from being exposed and being short-circuited with other coil portion except the coil terminal. The opening is preferred to be made inside by 50 $\mu$m or more to 200 $\mu$m or less from the periphery of the coil terminal portion and more preferred to be made inside by 100 $\mu$m or more to 200 $\mu$m or less. If a contact area with the external electrode is reduced too much, local heat is generated at the contact portion, thereby leading to such troubles as reduction of power efficiency at power supply and melt-down of the coil at worst. Therefore, area of the contact portion of the opening with the coil terminal portion is preferred to be 100 $\mu m^2$ or more.

The external electrode is disposed in the opening in the upper ferrite magnetic film. Preferably, this external electrode is formed by treating conductor paste composed of mainly one of Ni, Pd, Pt, Ag, Au or alloy powder containing these materials or solder paste composed of mainly Sn by heat treatment. Although an example of production method will be described about the conductor paste and solder paste, the present invention is not restricted to this example. In case of the conductor paste, after printing, it is baked at 700 to 950° C. At this time, it may be baked together with the upper ferrite magnetic film at the same time. On the other hand, for example, the solder paste has composition of 37Pb+63Sn, 90Pb+10Sn, 95Pb+5Sn. This solder paste is printed on the opening and melted by passing through a solder reflow furnace at 180 to 350° C. so as to produce the external electrode.

Meanwhile, a metal cap may be mounted on the external electrode formed on the upper ferrite magnetic film so that it is joined to the planar coil terminal by heat treatment.

If the external electrode is formed so as to be in contact with at least one side or two sides if possible of the device end portion, circuit wiring in the surface mounting type planar magnetic device is simplified preferably. As a means for connecting the planar magnetic device of the present invention to the circuit substrate, an example of soldering in the solder reflow process will be described in embodiments below. It is permissible to employ other connecting method such as wire bonding method and bump connection method to connect the external electrode of the planar magnetic device to a connecting terminal of the circuit substrate.

A completed product is produced by attaching the external electrode to the terminal portion of the planar coil. If the surface of the coil terminal portion is contaminated in halfway process, conduction failure is likely to occur. At this time, local heat is generated at a defective portion, thereby power efficiency at the power supply dropping or at worst a fatal trouble being generated such as destruction of the magnetic device. To prevent such troubles, preferably, a process for treating the surface of the coil terminal portion, that is, a process for light etching with acid or a process for washing with organic solvent is entered before a process for providing with the external electrode. Although as cleaning agent, for example, mixed acid such as Acetone, phosphoric acid, acetic acid, nitric acid and organic solvent such as dimethyl sulfoxide and N-methyl-2-pyrolidone may be used, the cleaning agent is not restricted to these. Because the baking of the upper ferrite magnetic film is carried out with the Cu coil existing inside, it is an important matter to prevent oxidation of the Cu during the baking. Although formation of coating film on the surface of the Cu coil is an effective means, the oxidation of the coil can be prevented by baking at 900° C. or more to 1050° C. or less in the atmosphere in which the concentration of oxygen is less than 1 vol. % after the upper ferrite magnetic film is applied. If the concentration of oxygen is less than 1 vol. %, the ferrite magnetic film can be baked without deteriorating DC resistance of the copper coil largely. At this time, if the temperature exceeds 1050° C., it is near the melting point of the copper coil, thereby inducing a change of the coil configuration or at worst melting-down of the coil. On the other hand, if the baking temperature is less than 900° C., the baking of the ferrite magnetic film is not accelerated sufficiently, so that a large inductance is not obtained and film strength is weakened. For the reasons, preferably, the concentration of oxygen in the atmosphere is less than 1 vol. % and the baking temperature is 900° C. or more to 1050° C. or less.

DETAILED DESCRIPTION OF THE PREFERRED EMBODIMENTS

Figure 1:
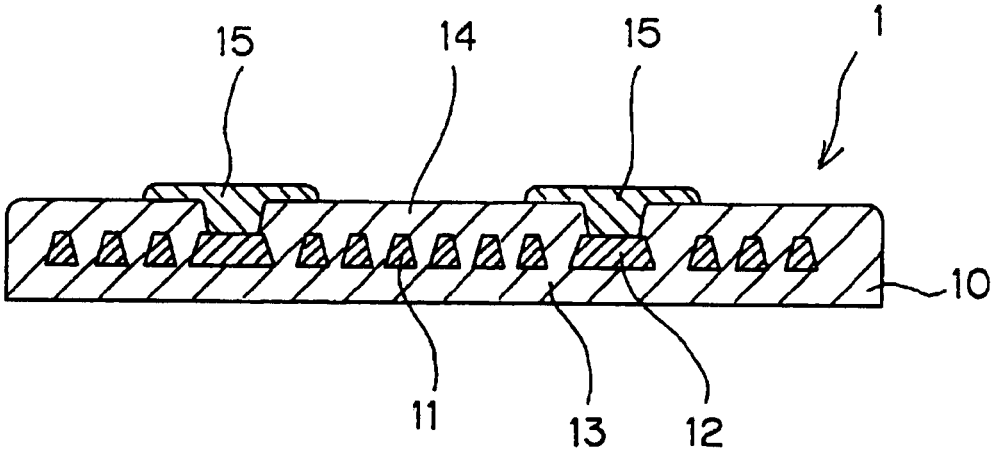
FIG. 1 is a sectional view taken along the line A—A of FIG. 2.
Figure 2:
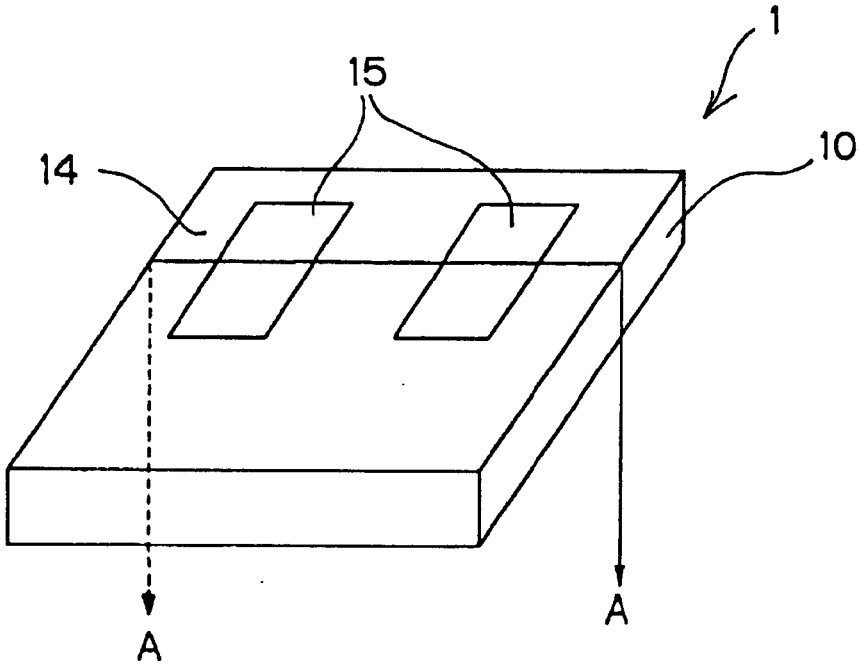
FIG. 2 is a perspective view of the surface mounting type planar magnetic device according to a first embodiment of the present invention.
Figure 3:
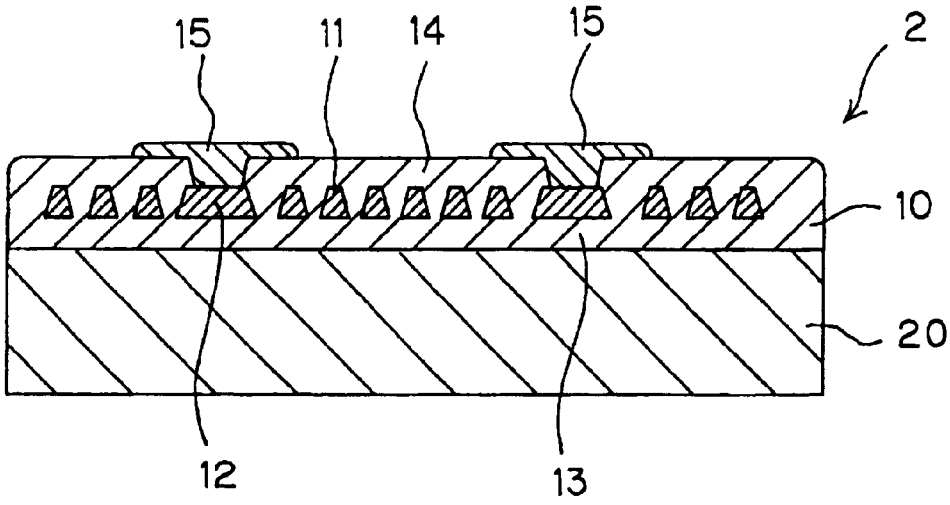
FIG. 3 is a sectional view taken along the line B—B of FIG. 4.
Figure 4:
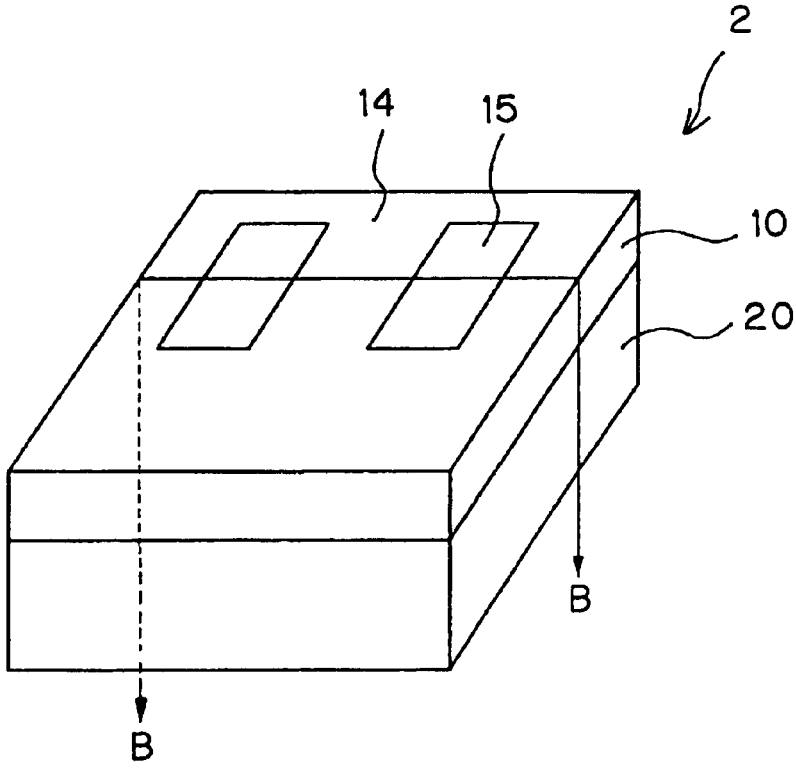
FIG. 4 is a perspective view of a second embodiment of the present invention.
Figure 5:
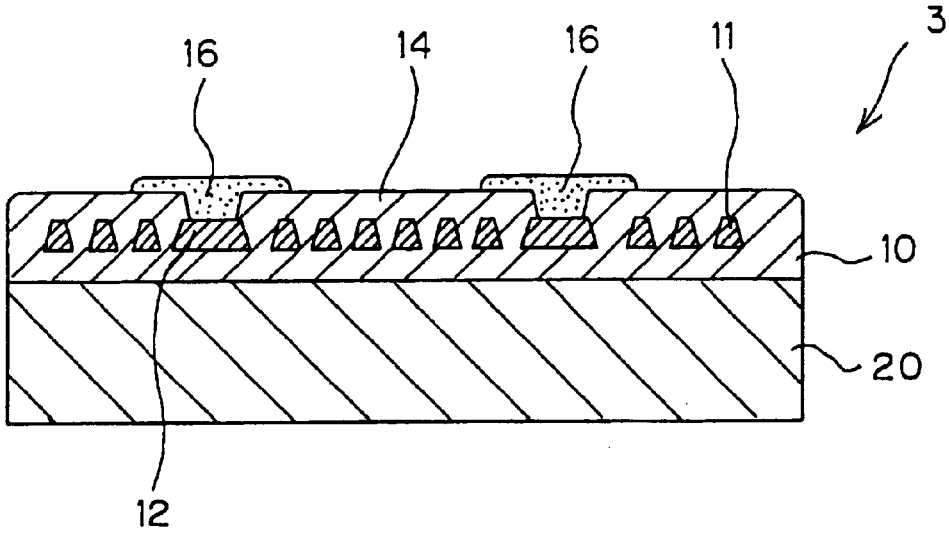
FIG. 5 is a sectional view taken along the line C—C of FIG. 6.
Figure 6:
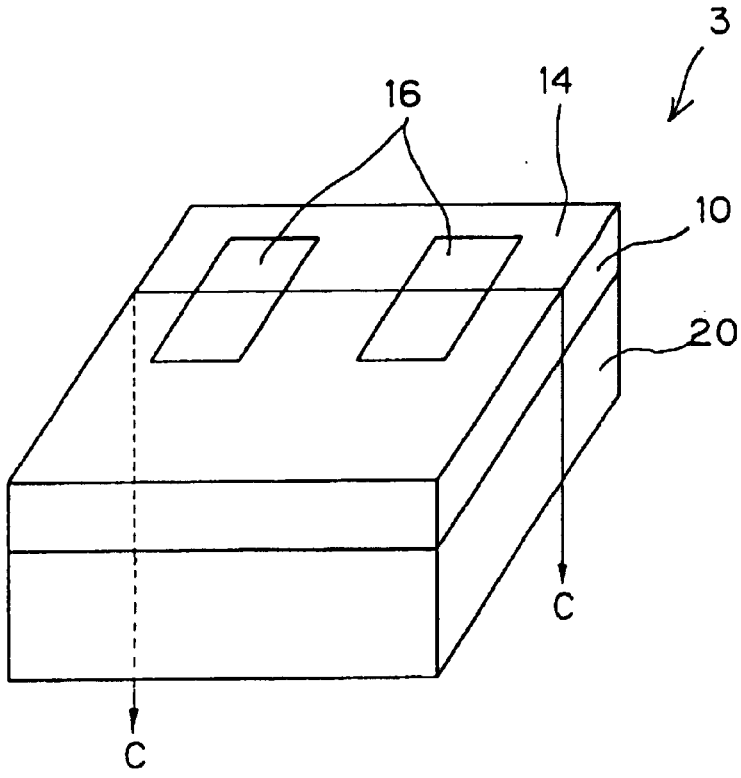
FIG. 6 is a perspective view of the embodiment.

The preferred embodiments of the present invention will be described with reference to the accompanying drawings. FIG. 2 is a perspective view of a surface mounting type planar magnetic device 1 according to a first embodiment of the present invention. FIG. 1 is a sectional view taken along the line A—A. The surface mounting type planar magnetic device 1 comprises upper ferrite magnetic film 14, lower ferrite magnetic film 13 and planar coil 11 interposed between the two films. An opening is formed in the upper ferrite magnetic film 14 above a terminal 12 of the coil and an external electrode 15 is formed on the upper ferrite magnetic film through this opening. FIG. 4 is a perspective view of a second embodiment of the present invention. FIG. 3 is a sectional view taken along the line B—B thereof. The lower ferrite magnetic film 13 is formed on a substrate 20 and a planar coil 11 is formed on the film 13. The upper ferrite magnetic film 14 is formed on the planar coil 11 such that there is an opening above the terminal portion 12. Then, the external electrode 15 is formed to be conductive with the terminal portion 12. Basically, an upper structure 10 loaded on the substrate 20 is the same as the first embodiment. As material of the substrate, Si substrate or alumina ($Al_2O_3$) substrate is used. FIGS. 5 and 6 show an example of an electrode formed by treating conductor paste composed of mainly one of Ni, Pd, Pt, Ag, Au of alloy powder containing these materials or solder paste mainly composed of Sn on the upper ferrite magnetic film 14 by heat treatment.

Figure 7:
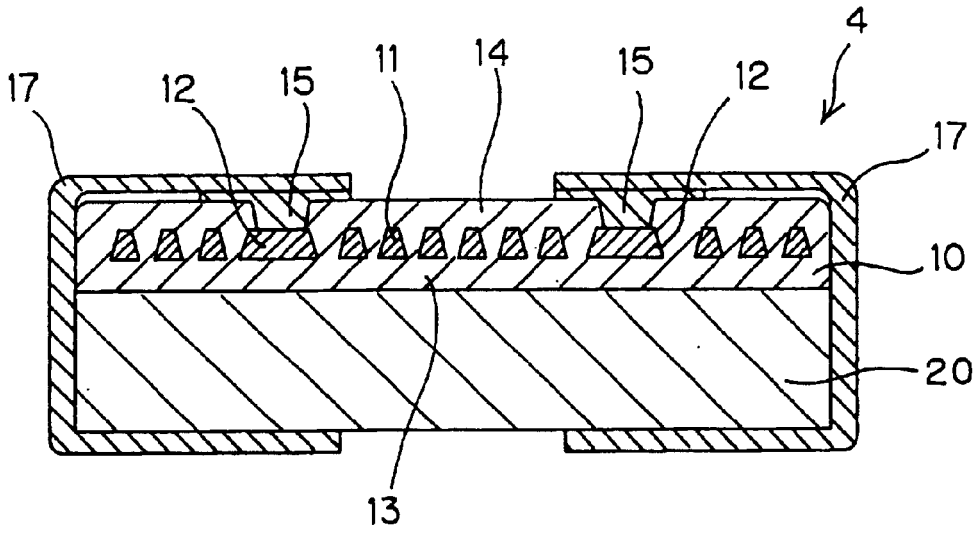
FIG. 7 is a sectional view taken along the line D—D of FIG. 8.
Figure 8:
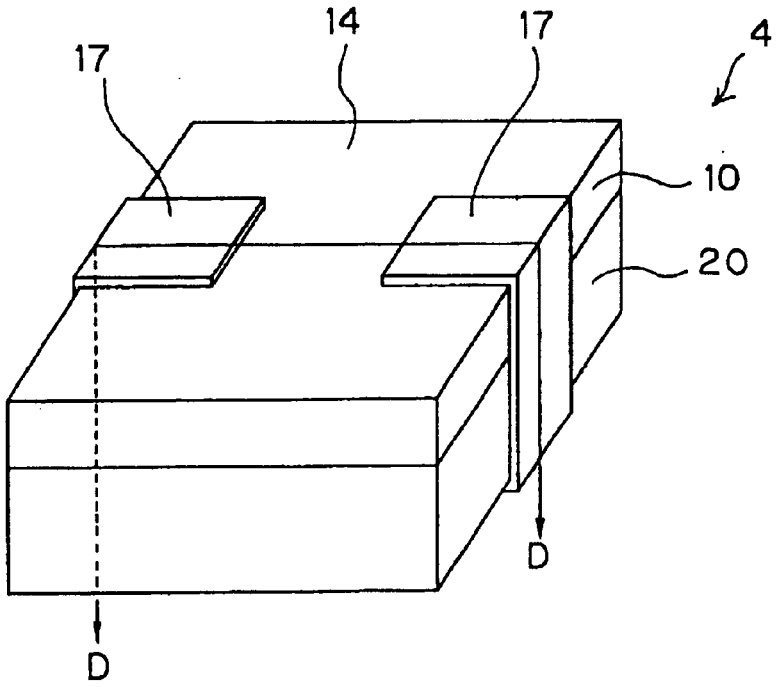
FIG. 8 is a perspective view of other embodiment.
Figure 9:
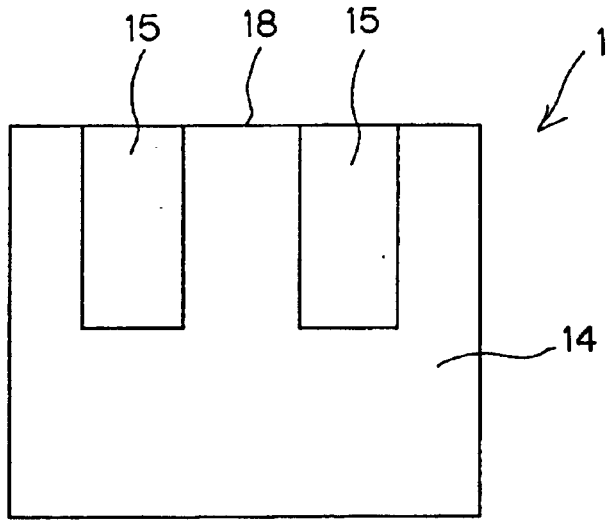
FIG. 9 is a plan view of the embodiment.
Figure 10:
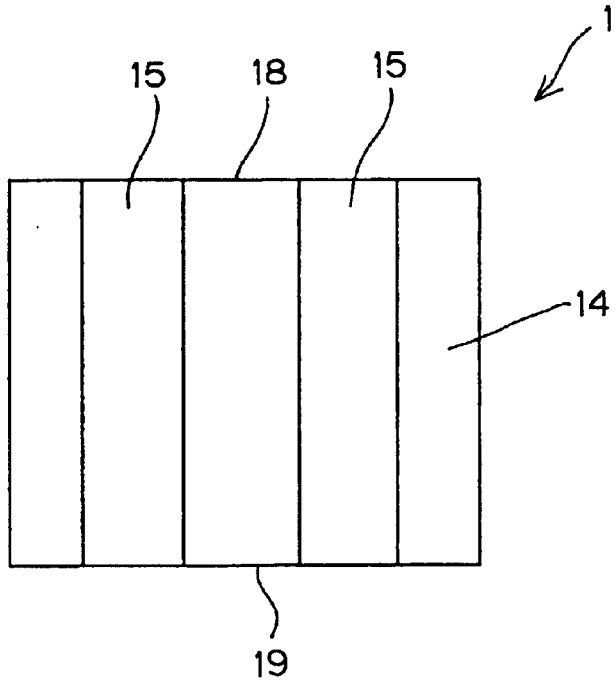
FIG. 10 is a plan view of the embodiment.

FIGS. 7 and 8 are a sectional view taken along the line D—D and a perspective view of an example in which a metal cap 17 is mounted on an external electrode 15 formed on ferrite magnetic film 14 and connected to the planar coil terminal 12 through the external electrode 15 by heat treatment. FIG. 9 is a plan view showing an example in which the external electrodes 15 are formed so as to be in contact with side 18 of a device end. FIG. 10 is a plan view showing an example in which the external electrodes 15 are formed so as to be in contact with two sides 18, 19 of a device end. This is a surface mounting of this device to the substrate, and it is advantage to positioning of the device.

Figure 11:
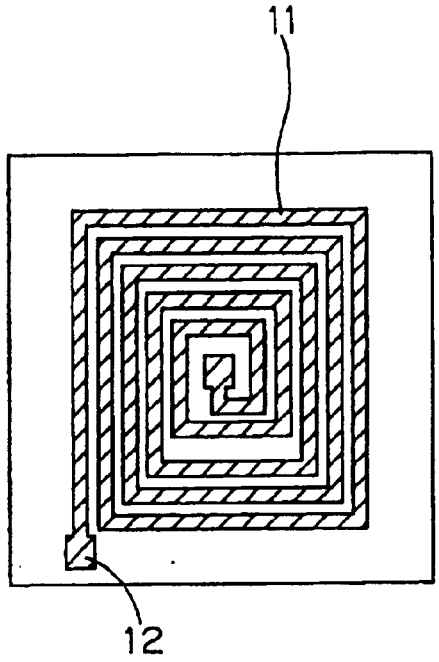
FIG. 11 is an explanatory diagram showing a configuration of a planar coil.
Figure 12:
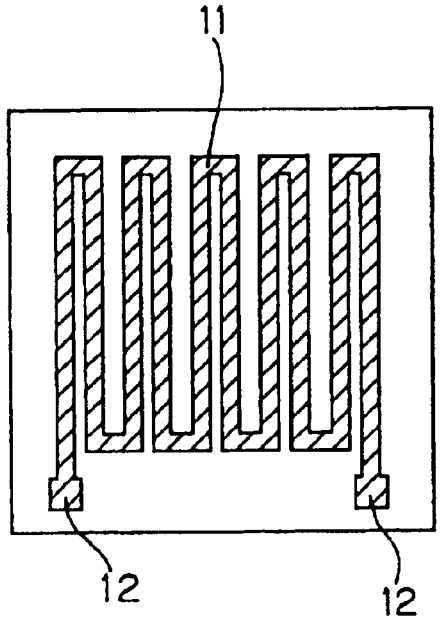
FIG. 12 is an explanatory diagram showing a configuration of the planar coil.
Figure 13:
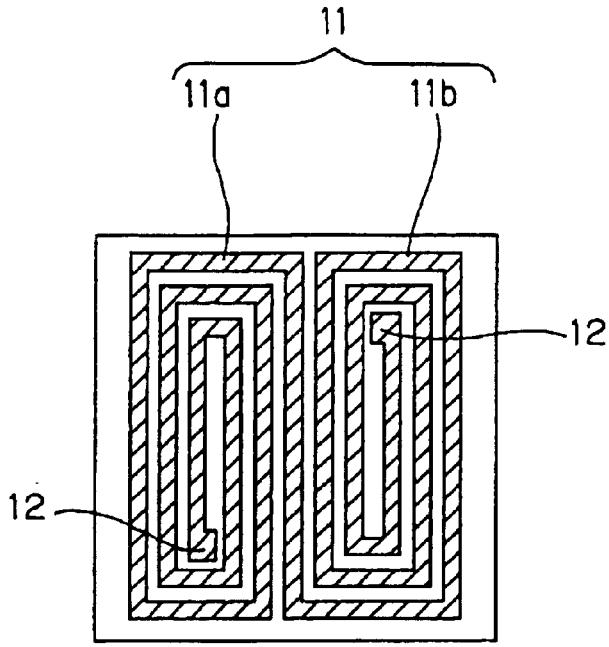
FIG. 13 is an explanatory diagram showing a configuration of the planar coil.
Figure 14:
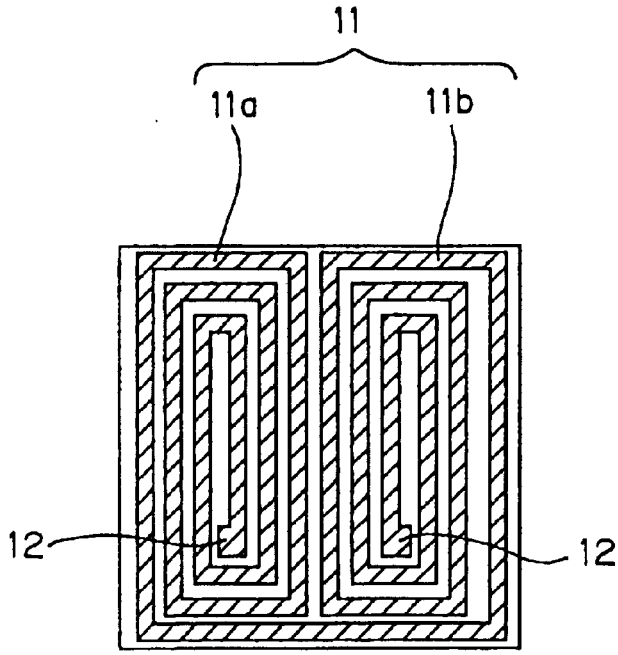
FIG. 14 is an explanatory diagram showing a configuration of the planar coil.

FIGS. 11 to 14 show the configurations of the planar coil relating to the present invention. FIG. 11 indicates a spiral type. FIG. 12 indicates meander type. FIG. 13 shows an example in which two spiral type planar coils 11*a*, 11*b* are joined together in series. FIG. 14 shows an another example in which two spiral type planar coils 11*a*, 11*b* are joined. According to these coil types, it is possible to obtain an inductance larger than times the inductance of a single spiral coil by the number of the coils.

Figure 15:
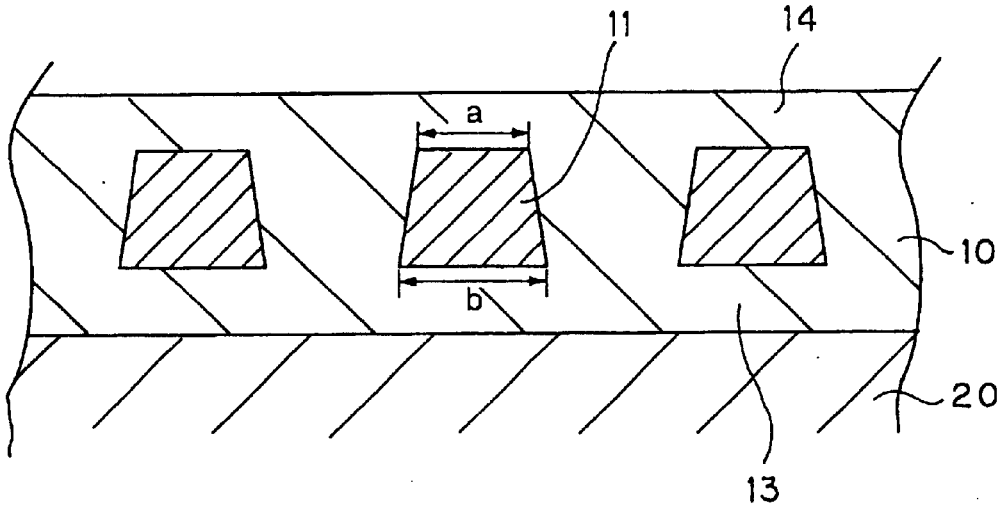
FIG. 15 is an explanatory diagram showing a configuration of the planar coil.
Figure 16:
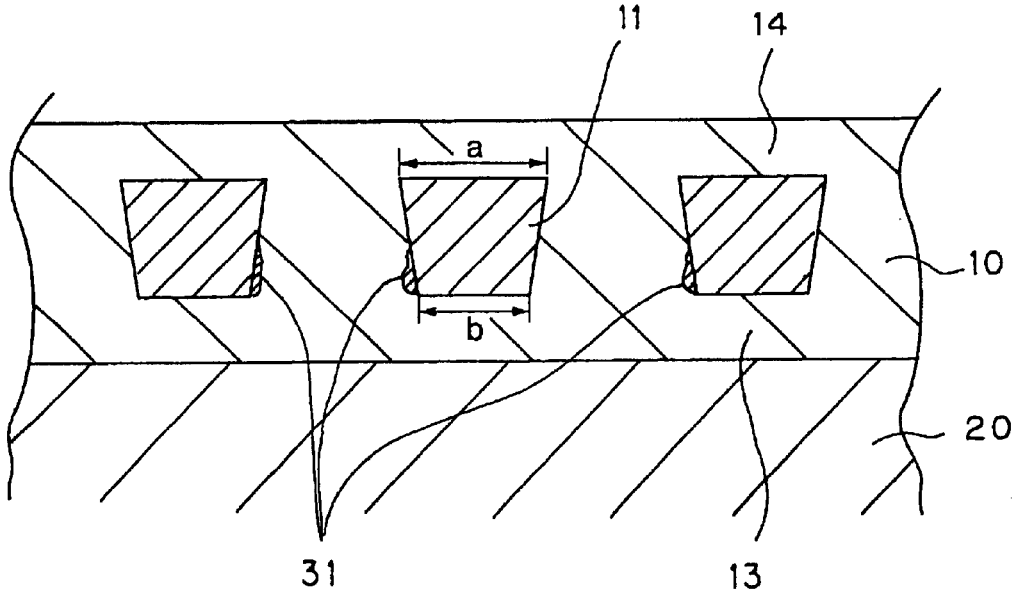
FIG. 16 is an explanatory diagram showing a configuration of the planar coil.

FIGS. 15 and 16 are explanatory diagrams of sectional shapes of the planar coils 11. As for the sectional shape of the planar coil, a side which the lower ferrite magnetic film 13 contacts is a lower bottom and a side which the upper ferrite magnetic film 14 contacts is a upper bottom. Where the upper bottom width is a and the lower bottom width is b, it is defined that a shape in which $b \geqq a$ (trapezoid including a rectangle) is forward taper and a shape in which $b<a$ is inverse taper. FIG. 15 indicates an example of the forward taper and FIG. 16 indicates the inverse taper. The section of the magnetic device planar coil of the present invention is preferred to be of the forward taper as shown in FIG. 15. In case of the inverse taper as shown in FIG. 16, area where the planar coil contacts the lower ferrite magnetic film 13 is small so that there is a problem in adhesion performance. Further, upper ferrite magnetic paste is not distributed evenly over the planar coil, so that a gap 31 is generated between the coil and ferrite magnetic film, thereby increasing disparity of inductance. However, the forward taper does not produce such a problem.

Figure 18:
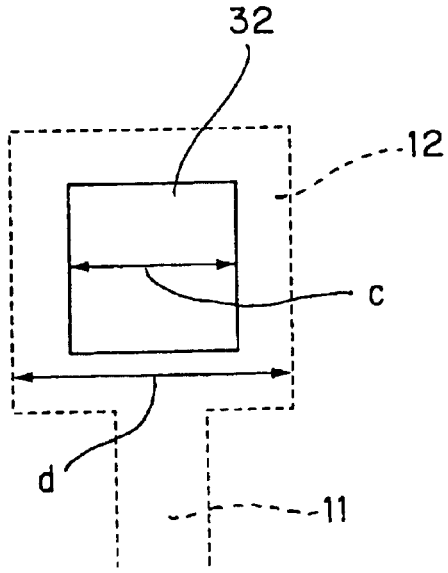
FIG. 18 is a partial diagram showing a relation between an opening of an upper ferrite magnetic film and a terminal portion of the planar coil.

FIG. 18 is a partial diagram showing a relation between an opening of the upper ferrite magnetic film and a terminal portion of the planar coil. The dimension c of an opening 32 is assumed to be $50\ \mu m<(d-c)/2 \leqq 200\ \mu m$ with respect to the dimension d of the terminal 12. Further preferably, this dimension is $100\ \mu m \leqq (d-c)/2 \leqq 200\ \mu m$. This is preferable for preventing a conductor portion following the planar coil terminal portion from being exposed and being short-circuited with the coil terminal. Further, the sectional area of the opening 32 is preferred to be 100 $\mu m^2$ or more.

Next, the examples of the present invention will be described in detail.

Example A

Paste containing ferrite magnetic powder of $Fe_2O_3$/ZnO/CuO=49/23/12 (mol %) composition (remainder: NiO) was applied to a Si substrate by screen printing method as the lower ferrite magnetic film and baked at 950° C. in the atmosphere. After baking, the film thickness was 40 $\mu m$. Next, a seed film composed of Nb(0.5 $\mu m$) and Cu(0.5 $\mu m$)was formed on the lower ferrite magnetic film by sputtering method. After photo resist was applied on this film, resist frame for double spiral coil of 40 $\mu m$ in line width and 40 $\mu m$ in line interval, 40 $\mu m$ in thickness and three turns+three turns was formed by photo etching. In this double spiral coil, two spiral coils each of three turns are arranged in parallel and mutual inductance between the both coils is positive.

Next, Cu was electroplated in the resist frame and after that, the resist frame was removed and the seed film of line interval was etched by wet and dry processes so as to produce a planar coil. Next, paste containing ferrite magnetic powder of $Fe_2O_3$/ZnO/CuO=49/23/12 (mol %) composition (remainder: NiO) was applied as the upper ferrite magnetic film by screen printing method and then, an external electrode was printed using Ag paste on its opening hole. After printing, this was baked at 930° C. in the nitrogen gas atmosphere (oxygen concentration 0.1%). The film thickness from coil top after baking was 40 μm. Next, Ni/Sn was plated on the Ag electrode. Consequently, a surface mounting type planar magnetic device having an external electrode having dimensions of 5 mm×5 mm×0.8 mmt was obtained. By leaving this surface mounting type planar magnetic device in the atmosphere of 90° C., 95% RH (Relative Humidity) for 15 hours, the substrate was separated so as to obtain a substrate free surface mounting type planar magnetic device. FIGS. 2 and 4 show appearances (perspective) of the substrate free and substrate provided surface mounting type planar magnetic devices as the examples 1 and 2. The surface mounting technology can be applied to both of them to have an external electrode and in case of the substrate free device, a very thin device is achieved. The characteristic of the magnetic device under the condition of 5 MHz is all shown in Table 1 as examples 1 and 2. This table indicates that any substrate indicates an excellent characteristic.

Example B $Al_2O_3$ was used as a substrate and a magnetic device was produced in the same process as the example A. These examples 3 and 4 are shown in Table 1. The characteristic of the magnetic device under the condition of 5 MHz is shown in Table 1 as examples 3 and 4. This table indicates that any substrate indicates an excellent characteristic.

TABLE 1

| | Substrate | Inductance (μH) | Quality factor Q |
|---|---|---|---|
| Example 1 | Si | 2.0 | 12 |
| Example 2 | — | 2.1 | 13 |
| Example 3 | $Al_2O_3$ | 2.2 | 13 |
| Example 4 | — | 2.0 | 15 |

Quality factor Q is expressed by the expression (4).

$$Q=2\pi f\,L/Rs \tag{4}$$

where f=frequency (Hz), Rs (loss factor of inductance)=Rac+Rdc

Rac: AC resistance of inductance

Rdc: Dc resistance of inductance

The quality factor Q, was desired to exceed ten.

Example C

Spiral arrangement, series arrangement of spiral, parallel arrangement of spiral and meander arrangement were used and a magnetic device shown in Table 2 was produced in the same process as the example A. Respective characteristics (under the condition of 5 MHz) are indicated in Table 2 as examples 5 to 8. The number of turns in the meander coil here refers to the number of folds. According to this Table 2, it is found that when the spiral coil is used, an inductance larger than the meander coil can be obtained and that two spiral coils are connected in series same as FIG. 13 and FIG. 14 such that mutual inductance between the coils is positive, an inductance twice or more larger than when a single spiral coil is used can be obtained.

TABLE 2

| | Coil Specification | Number of Turns N | Inductance (μH) | Quality factor Q |
|---|---|---|---|---|
| Example 5 | Meander | 3 | 0.3 | 10 |
| Example 6 | Spiral | 3 | 0.8 | 15 |
| Example 7 | Arrangement of Spiral in Series same as FIG. 13 | 3 + 3 | 2.0 | 12 |
| Example 8 | Arrangement of Spiral in Series same as FIG. 14 | 3 + 3 | 1.6 | 13 |

Example D

Figure 17:
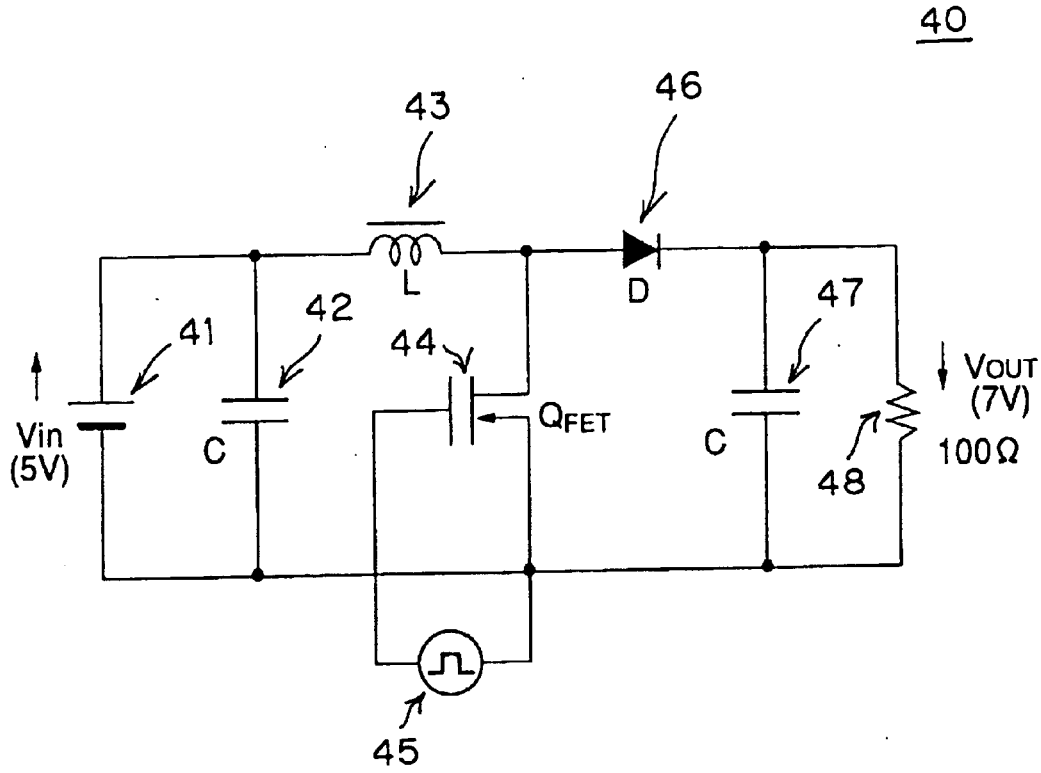
FIG. 17 is a circuit diagram of a DC/DC converter.

The condition of this example including the structure of coil is the same as the example A except that Cu, Ni and Ag shown in Table 3 are used as the coil material. In each case, an inductance and direct resistance Rdc, under the condition of 5 MHz was measured. By loading the coil on a DC/DC converter shown in FIG. 17 as a chalk coil and driving it at rectangular wave of 0.5 in pulse interval ratio (duty ratio) and 5 MHz, power efficiency was obtained. The power efficiency was obtained by a ratio of output power relative to input power in a circuit shown in FIG. 17. In the DC/DC converter 40 shown in FIG. 17, a pulse from a pulse generator 45 is applied to a circuit comprising a capacitor 42, a chalk 43 and a MOS-FET 44 so as to convert DC input 41 to alternate current and then the voltage is raised. Then, DC output 48 is outputted to a rectifying circuit comprising a diode 46 and a capacitor 47. Table 3 shows measurement results as the examples 9 to 11. It is found that the example 9 using Cu has exerted the highest performance.

TABLE 3

| | coil material | Rdc (Ω) | Inductance (μH) | Power Efficiency (%) |
|---|---|---|---|---|
| Example 9 | Cu | 0.5 | 2.0 | 87 |
| Example 10 | Ni | 2.2 | 1.8 | 70 |
| Example 11 | Ag | 0.5 | 1.7 | 80 |

Example E

Nb, Ta, Mo, W or Cu film was formed on the lower ferrite magnecit film produced in the method described in the example A, in total film thickness of 1 μm by sputtering method according to a specification shown in Table 4. Consequently, a coil pattern was formed on this film by the same electro plating as the example A. For comparison, the same patterns were formed by electroless deposition and printing/baking method. Examples 12 to 18 of Table 4 show DC resistance Rdc and adhesion strength of each case. The adhesion strength was measured by tape test. The adhesion strength is expressed by a relative strength assuming that the value when all film is formed of Cu (Example 12) is 1. As a result, it is found that a preferable coil is produced in the examples 13 to 16 in which electro plating is applied to not a Cu single layer (Example 2) but multiple-layer of Nb, Ta, Mo or W and Cu. Meanwhile, in the tape test, 100 pieces of each sample (pattern shape 5×5 (mm)) are left in the atmosphere of 85° C. in temperature and 98% RH in humidity for four hours and then, adhesive tape is applied and then removed. Then, a rate that no peeling occurs is obtained.

TABLE 4

| | Coil | Plating Foundation | Rdc (Ω) | Adhesion Strength (Relative Value) |
|---|---|---|---|---|
| Example 12 | Electro Plating | Cu | 0.5 | 1.0 |
| Example 13 | Electro Plating | Nb + Cu | 0.5 | 1.5 |
| Example 14 | Electro Plating | Ta + Cu | 0.5 | 1.4 |
| Example 15 | Electro Plating | Mo + Cu | 0.5 | 1.6 |
| Example 16 | Electro Plating | W + Cu | 0.5 | 1.6 |
| Example 17 | Electroless Deposition | No | 5.8 | 1.3 |
| Example 18 | Printing/Baking | No | 1.7 | 1.6 |

Example F

Table 5 shows relative adhesion strengths and disparities of inductance (number of specimen n=50) of coils having forward taper and inverse taper in its section when a magnetic device is produced in the same method as the example A. The adhesion strength was measured in the same tape test as the example E before the upper ferrite magnetic film was formed. The measured value is expressed by a relative value assuming that the value when a ratio of upper bottom width a and lower bottom width b is 1 is 1. The forward taper and inverse taper were produced by controlling exposure and development condition. a/b in the Table indicates a ratio of upper bottom width a and lower bottom width b. In case of the forward taper, a/b≦1 and in case of inverse taper, a/b>1. The disparity of inductance was a ratio of a maximum apart value from average value and the average value. As evident from Table 5, the examples 19 to 21 in which the coil section is forward taper indicate an excellent characteristic having a small disparity in inductance and good adhesion strength of the coil.

TABLE 5

| | Taper | a/b | Disparity of Inductance (%) | Adhesion Strength |
|---|---|---|---|---|
| Example 19 | Forward | 1 | 5 | 1 |
| Example 20 | Forward | 0.8 | 3 | 1.3 |
| Example 21 | Forward | 0.9 | 4 | 1.2 |
| Example 22 | Inverse | 1.2 | 8 | 0.7 |
| Example 23 | Inverse | 1.5 | 10 | 0.6 |
| Example 24 | Inverse | 1.1 | 7 | 0.8 |

Example G

Table 6 shows coil DC resistance Rdc, power efficiency and resonant frequency when a coil is loaded on a DC/DC converter when its coil interval is fixed to 40 μm in the same method as the example A and the coil thickness is changed in various ways. The structure and driving condition of the DC/DC converter are the same as example D. From Table 6, it is found that the higher resonant frequency and higher power efficiency in the DC/DC converter can be achieved at the same time in the examples 26 to 29 in which the coil thickness is 10 to 100 μm.

TABLE 6

| | Coil Thickness (μm) | Rdc (Ω) | Power Efficiency (%) | Resonant Frequency (MHz) |
|---|---|---|---|---|
| Example 26 | 10 | 2 | 77 | 120 |
| Example 27 | 40 | 0.5 | 87 | 60 |
| Example 28 | 70 | 0.3 | 88 | 45 |
| Example 29 | 100 | 0.2 | 90 | 12 |
| Example 30 | 6 | 3 | 55 | 155 |
| Example 31 | 2 | 10 | 40 | 270 |
| Example 32 | 150 | 0.1 | 92 | 10 |

Example H

After the lower ferrite magnetic film was formed in the same method as the example A, coating material shown in Table 7 was applied and a planar coil was formed. After that, the coating material was applied to cover the entire ferrite and the coil with the film again. Next, the upper ferrite magnetic film was formed by screen printing and baked at 910° C. in the atmosphere. Table 7 shows coil DC resistance Rdc, inductance and quality factor Q of each case. From this Table, it is found that by forming a film of $SiN_x$ ($1 \leqq x \leqq 1.5$), $AlN_y$ ($0.8 \leqq y \leqq 1.2$), $Al_2O_3$ or multi-layer of these substances constituted thereof in the thickness of 0.1 to 10 μm, an excellent characteristic is obtained. Meanwhile, the coating material at the opening is desired to be removed after the upper ferrite magnetic film is baked. By removing it after baking, oxidation of the coil accompanied by the baking can be prevented.

TABLE 7

| | Coating Material | Film Thickness (μm) | Rdc (Ω) | Inductance (μH) | Quality factor Q |
|---|---|---|---|---|---|
| Example 33 | $SiN_x$ | 0.3 | 0.6 | 2.2 | 12 |
| Example 34 | $AlN_y$ | 9 | 0.5 | 2.1 | 13 |
| Example 35 | $Al_2O_3$ | 3 | 0.5 | 2.3 | 11 |
| Example 36 | $SiN_x/AlN_y$ | 7 | 0.5 | 2.0 | 12 |
| Example 37 | $AlN_y/Al_2O_3$ | 0.8 | 0.5 | 2.2 | 13 |
| Example 38 | $SiN_x/Al_2O_3$ | 5 | 0.5 | 2.0 | 12 |
| Example 39 | $Al_2O_3$ | 0.06 | 2.5 | 2.2 | 8 |
| Example 40 | $SiN_x$ | 13 | 0.5 | 1.8 | 8 |

Example I

After the upper ferrite magnetic film was formed in the same method as the example A, the surface of a terminal of the opening was treated in a method shown in Table 8. DC resistance Rdc between the external electrodes was evaluated, and Table 8 shows its disparity (%) with a maximum apart value from the average value. From this Table 8, it is found that if the surface treatments are carried using $H_2SO_4$ of acid and acetone of organic solvent, an excellent resistance between external electrodes having a small disparity in coil DC resistance Rdc is generated.

TABLE 8

| | Treatment | Disparity of Rdc (%) |
|---|---|---|
| Example 41 | Treatment with Acetone | 5 |
| Example 42 | Treatment with $H_2SO_4$ | 3 |
| Example 43 | No Treatment | 12 |

Example J

A magnetic device was produced in the same method as the example A except that ferrite magnetic film having composition shown in Table 9 was used. Then, its inductance (under the condition of 5 MHz), quality factor (Q), saturation magnetization (T) of ferrite material and Curie temperature (Tc) were measured and summarized in Table 9. From Table 9, it is found that an excellent characteristic is obtained in the examples 44 to 47 and 51 within the composition range specified by the present invention.

TABLE 9

| | $Fe_2O_3$ mol % | ZnO mol % | CuO mol % | $Bi_2O_3$ mol % | Saturation Magnetization T | Tc ° C. | Inductance μH | Quality factor Q |
|---|---|---|---|---|---|---|---|---|
| Example 44 | 49 | 22 | 20 | 0 | 0.345 | 330 | 2.3 | 12 |
| Example 45 | 45 | 15 | 0 | 7 | 0.370 | 380 | 2.0 | 11 |
| Example 46 | 41 | 29 | 0 | 3 | 0.383 | 200 | 2.1 | 13 |
| Example 47 | 49.5 | 19 | 13 | 0 | 0.420 | 320 | 2.4 | 13 |
| Example 48 | 49 | 33 | 0 | 11 | 0.300 | 140 | 2.3 | 12 |
| Example 49 | 38 | 30 | 11 | 1 | 0.330 | 190 | 1.2 | 13 |
| Example 50 | 52 | 21 | 13 | 0 | 0.410 | 320 | 0.9 | 3 |
| Example 51 | 49 | 13 | 15 | 2 | 0.400 | 390 | 1.1 | 10 |
| Example 52 | 49.5 | 37 | 9.5 | 2 | 0.250 | 50 | 2.1 | 11 |
| Example 53 | 49 | 24 | 23 | 2 | 0.220 | 260 | 1.0 | 11 |
| Example 54 | 49 | 24 | 1 | 13 | 0.380 | 270 | 0.7 | 12 |

Note: remainder of ferrite magnetic film composition is NiO.

Example K

A magnetic device was produced in the same method as the example A except that the thickness of the ferrite magnetic film is changed to values shown in Table 10. Table 10 shows inductance and film condition. From this result, it is found that excellent film condition with no peeling is compatible with inductance in ferrite film thickness of 10 to 100 μm in the example 55 to 58.

TABLE 10

| | Film Thickness (μm) | Inductance (μH) | Film Condition |
|---|---|---|---|
| Example 55 | 10 | 1.0 | Excellent |
| Example 56 | 40 | 2.1 | Excellent |
| Example 57 | 80 | 4.0 | Excellent |
| Example 58 | 100 | 4.8 | Excellent |
| Example 59 | 5 | 0.3 | Excellent |
| Example 60 | 2 | 0.1 | Excellent |
| Example 61 | 150 | 60 | Peeling |

Example L

The lower ferrite magnetic film was printed on the Si substrate such that a first layer was 7 μm in thickness and a second layer was 30 μm in thickness (film thickness after baking) and then baked at 910 to 1250° C. in the atmosphere. The concentration of CuO in the lower ferrite magnetic film of the second layer was fixed to 15 mol % and the concentration of CuO of the first layer was changed in a range of 0 to 15 mol % as shown in Table 11. After leaving in the environment of 85° C., 95% RH for five hours, the lower ferrite magnetic film was subjected to tape test so as to evaluate its adhesion strength in the same method as the example E. Table 11 shows its result. The strength is expressed by a relative value assuming that the value (when the Cuo concentration of the first layer is 0 mol %) is 1. From this result, it is found that when the CuO concentration of the first layer is not more than 5 mol %, an excellent adhesion strength is obtained in the examples 62 to 65.

TABLE 11

| | CuO Concentration (mol %) of an Interface between Substrate and Ferrite | Adhesion Strength (Relative Value) |
|---|---|---|
| Example 62 | 0 | 1 |
| Example 63 | 1 | 0.9 |
| Example 64 | 3 | 0.8 |
| Example 65 | 5 | 0.75 |
| Example 66 | 6 | 0.4 |
| Example 67 | 9 | 0.3 |
| Example 68 | 12 | 0.2 |

Example M

The lower ferrite magnetic film having the same composition as the example A was printed on Si substrate so that the film thickness was 40 μm after baking and baked at 850 to 1250° C. in the atmosphere. Cracks were generated in the film by controlling baking temperature and cooling rate and an equivalent diameter of a portion surrounded by the cracks was changed as shown in Table 12. Table 12 shows the equivalent diameter, amount of warp and absence/presence of ferrite peeling. The amount of warp is expressed by a dimension from top to bottom in 100 mmΦ. From this result, it is found that the amount of warp is small in the examples 69 to 72 in which the average of the equivalent diameter is not more than 100 μm, so that an excellent film condition without peeling can be achieved.

TABLE 12

| | Average of Equivalent diameter (μm) | Amount of Warp (μm) | Absence/Presence of Peeling |
|---|---|---|---|
| Example 69 | 100 | 20 | Absence |
| Example 70 | 20 | 10 | Absence |
| Example 71 | 60 | 7 | Absence |
| Example 72 | 10 | 9 | Absence |
| Example 73 | No Crack | 200 | Absence |
| Example 74 | 120 | 7 | Presence |
| Example 75 | 550 | 8 | Presence |

Example N

A magnetic device was produced in the same method as the example A except that the upper ferrite magnetic film is baked under the condition shown in Table 13. Table 13 shows coil DC resistance Rdc, inductance and power efficiency when the magnetic device was driven in the same condition as the example D. From this result, it is found that the examples 76 to 78 maintain an excellent characteristic when the concentration of oxygen in the atmosphere is not more than 1 vol. % and the baking temperature is 900 to 1050° C. In the examples 79 and 80, because the concentration of oxygen in the atmosphere exceeds 1 vol. %, the Cu coil is oxidized and Rdc increases. In the examples 81 and 82, the baking temperature is high, so that the Cu coil is melt down.

TABLE 13

| | Concentration of Oxygen (vol. %) in the atmosphere | Baking Temperature (° C.) | Rdc (Ω) | Inductance (μH) | Power Efficiency (%) |
|---|---|---|---|---|---|
| Example 76 | 0.2 | 930 | 0.5 | 2.1 | 85 |
| Example 77 | 1 | 920 | 0.7 | 2.2 | 83 |
| Example 78 | 0.05 | 950 | 0.4 | 2.2 | 87 |
| Example 79 | 3 | 930 | 20 | 1.8 | 30 |
| Example 80 | 10 | 930 | 1000 | — | — |
| Example 81 | 0.5 | 1100 | Breaking | — | — |
| Example 82 | 0.3 | 1120 | Breaking | — | — |

Example O

A magnetic device was produced in the same method as the example A except that a relation between the coil terminal and the opening was changed and then, DC resistance Rdc between the external electrodes was measured. Where the dimension of an opening of the upper ferrite magnetic film is c and the dimension of a planar coil terminal portion is d as shown in FIG. 18, (d−c)/2 was changed to 50 to 300 μm. An opening area A was changed to 50 to 1500 $\mu m^2$. Table 14 shows a measurement result of the DC resistance Rdc. From Table 14, it is found that if an opening is inside by 50 μm or more to 200 μm or less, more preferably 100 μm or more to 200 μm or less of the periphery of the planar coil terminal portion ((d−c)/2) and the contact portion area A is 100 $\mu m^2$ or more, the examples 83 to 85 can achieve an excellent contact between the coil terminal and external electrode. In the example 86, because the opening is large, the external electrode is short-circuited to other coil portion than the coil terminal. In the examples 87 and 88, the contact portion area A is small so that Rdc is increased.

TABLE 14

| | (d-c)/2 | A ($\mu m^2$) | Rdc (Ω) |
|---|---|---|---|
| Example 83 | 200 | 100 | 1.0 |
| Example 84 | 100 | 800 | 0.8 |
| Example 85 | 50 | 1500 | 0.7 |
| Example 86 | 40 | 1700 | Short-Circuit |
| Example 87 | 300 | 50 | 10 |
| Example 88 | 100 | 70 | 7 |

Example P

Figure 19:
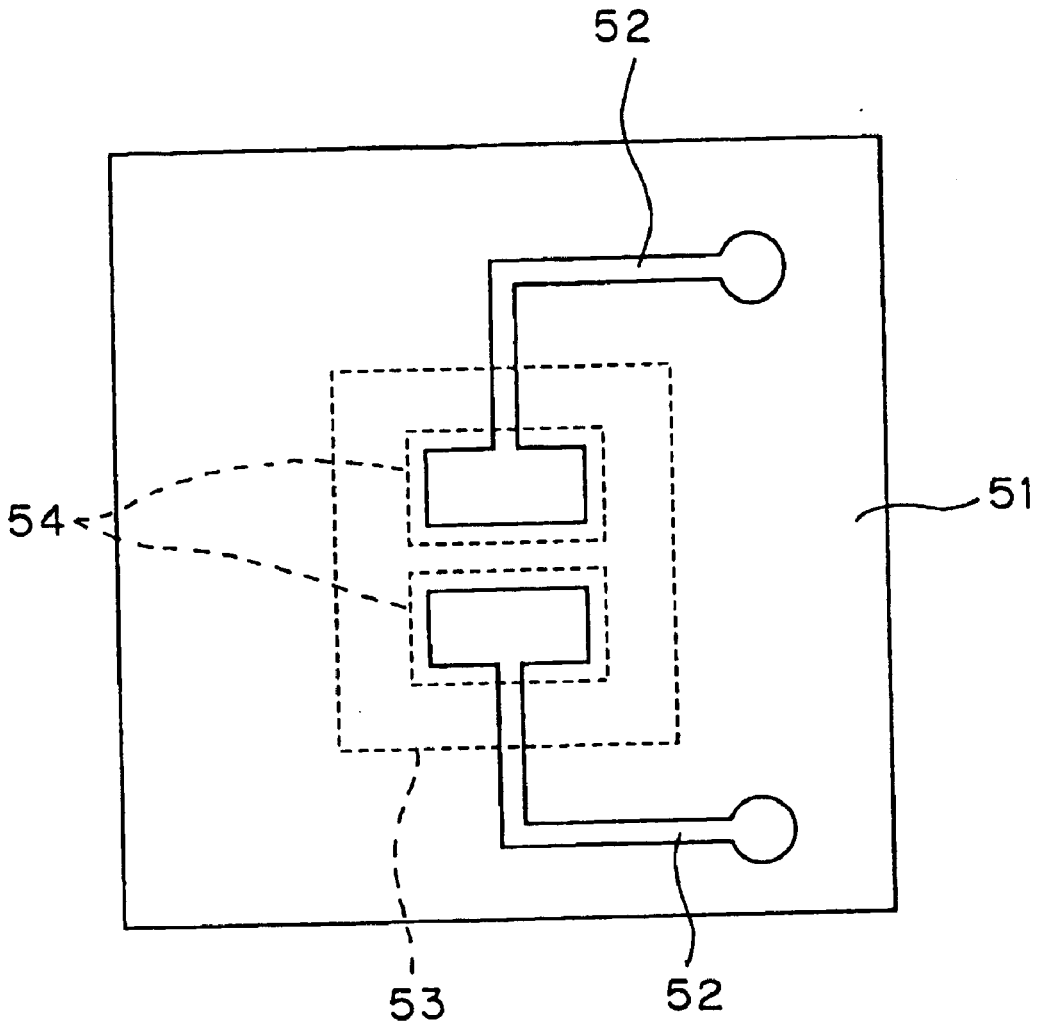
FIG. 19 is an explanatory diagram showing wiring on a printed board.

After the upper ferrite magnetic film was produced in the same method as the example A, paste of external electrode material of the specification shown in Table 15 was applied to the opening and treated by heat so as to produce an external electrode. A magnetic device 53 having an external electrode 54 was loaded on a printed substrate 51 with wiring pattern shown in FIG. 19 so as to form wiring 52 and passed through a soldering reflow furnace. Table 15 shows heat treatment temperature. Table 15 shows adhesion condition and DC resistance between the terminals 52 and 52. From this result, it is found that excellent adhesion condition and DC resistance can be obtained by providing with the external electrode of the present invention.

TABLE 15

| | External Electrode Material | Rdc (Ω) | Adhesion Condition | Heat Treatment Temperature (° C.) |
|---|---|---|---|---|
| Example 89 | Mi | 0.6 | Excellent | 950 |
| Example 90 | Ag | 0.5 | Excellent | 750 |
| Example 91 | Au | 0.5 | Excellent | 800 |
| Example 92 | Ag—Pd | 0.7 | Excellent | 850 |
| Example 93 | Cu | 0.6 | Excellent | 900 |
| Example 94 | Pt | 0.6 | Excellent | 920 |
| Example 95 | soldering paste | 0.5 | Excellent | 250 |

Example Q

Table 16 shows comparison of the characteristics in case where the example 96 uses the same structure as the example B while as a comparative example 1, the same coil structure as the example 96is used and the upper and lower magnetic films are made of Fe—Co—B—C amorphous film. The both magnetic films were fixed to 4000 μm in μr×tm (μr is relative permeability, tm is film thickness) and compared with each other. From Table 16, it is evident that an inductor of the present invention (Example 96) achieved higher inductance and higher quality factor Q than the comparative example.

TABLE 16

| | Inductance (μH) | Quality factor Q |
|---|---|---|
| Example 96 | 2.0 | 15 |
| Comparative Example 1 | 1.0 | 11 |

What is claimed is:

1. A surface mounting type planar magnetic device comprised of upper ferrite magnetic film, lower ferrite magnetic film and a planar coil interposed therebetween, in which an opening is formed in said upper ferrite magnetic film above a planar coil terminal portion and an external electrode conductive with said coil terminal portion through said opening is formed on said upper ferrite magnetic film, wherein the planar coil is composed of a Cu conductor and the thickness of the planar coil is 10 μm or more to 100 μm or less.

2. A surface mounting type planar magnetic device according to claim 1 wherein the planar coil is a spiral coil or a combination of plural spiral coils connected in series.

3. A surface mounting type planar magnetic device according to claim 1 wherein the sectional shape of the planar coil is of forward taper.

4. A surface mounting type planar magnetic device according to claim 1 wherein a coating film composed of $SiN_x$ ($1 \leqq x \leqq 1.5$), $AlN_y$ ($0.8 \leqq y \leqq 1.2$), $Al_2O_3$ or multiple layer constituted thereof in the thickness of 0.1 μm or more to 10 μm or less on the surface of the planar coil excluding a top face of the terminal.

5. A surface mounting type planar magnetic device according to claim 1 wherein the opening is inside by 50 μm or more to 200 μm or less of the periphery of the planar coil terminal portion while the area of a contact portion in which the coil terminal portion of the opening is in contact with the external electrode is 100 $\mu m^2$ or more.

6. A surface mounting type planar magnetic device according to claim 1 wherein the external electrode is connected to the coil terminal portion by treating conductor paste composed of mainly a metal on an alloy of one or more selected from a group of Ni, Pd, Pt, Ag, Au or soldering paste composed of mainly Sn, disposed on the upper ferrite magnetic film by heat treatment.

7. A surface mounting type planar magnetic device according to claim 1 wherein a metal cap is mounted on the external electrode formed on the upper ferrite magnetic film and connected to the coil terminal portion by heat treatment.

8. A surface mounting type planar magnetic device according to claim 1 wherein the external electrode is formed so as to be in contact with a side or two sides of a device end portion.

9. A surface mounting type planer magnetic device according to claim 1, wherein the thickness of the planer coil is 40 $\mu$m or more to 100 $\mu$m or less.

10. A surface mounting type planar magnetic device comprised of upper ferrite magnetic film, lower ferrite magnetic film and a planar coil interposed therebetween, in which an opening is formed in said upper ferrite magnetic film above a planar coil terminal portion and an external electrode conductive with said coil terminal portion through said opening is formed on said upper ferrite magnetic film, wherein the planar coil is composed of a Cu conductor and the thickness of the planar coil is 10 $\mu$m or more to 100 $\mu$m or less, wherein average composition of the upper ferrite magnetic film and the lower ferrite magnetic film is $Fe_2O_3$: 40 to 50 mol %, ZnO: 15 to 35 mol %, CuO: 0 to 20 mol %, $Bi_2O_3$: 0 to 10 mol % while remainder thereof is composed of NiO and unavoidable impurity.

11. A surface mounting type planar magnetic device according to claim 1 wherein the thickness of the lower ferrite magnetic film is 10 $\mu$m or more to 100 $\mu$m or less.

12. A surface mounting type planar magnetic device comprised of upper ferrite magnetic film, lower ferrite magnetic film and a planar coil interposed therebetween, in which an opening is formed in said upper ferrite magnetic film above a planar coil terminal portion and an external electrode conductive with said coil terminal portion through said opening is formed on said upper ferrite magnetic film, wherein the planar coil is composed of a Cu conductor and the thickness of the planar coil is 10 $\mu$m or more to 100 $\mu$m or less, wherein the planar coil is composed of the Cu conductor formed by electro plating with two-layered film comprising a film composed of a metal selected from Nb, Ta, Mo and W or alloy constituted of two or more thereof and Cu film as plating foundation.

13. A production method of a surface mounting type planar magnetic device wherein upon production of a surface mounting type planar magnetic device comprised of upper ferrite magnetic film, lower ferrite magnetic film and a planar coil interposed therebetween, in which an opening is formed in said upper ferrite magnetic film above a planar coil terminal portion and an external electrode conductive with said coil terminal portion through said opening is formed on said upper ferrite magnetic film, wherein the planar coil is composed of a Cu conductor and the thickness of the planar coil is 10 $\mu$m or more to 100 $\mu$m or less, a planar coil terminal is subjected to surface treatment prior to coupling of a planar coil terminal portion and an external electrode.

14. A production method of a surface mounting type planar magnetic device wherein upon production of a surface mounting type planar magnetic device comprised of upper ferrite magnetic film, lower ferrite magnetic film and a planar coil interposed therebetween, in which an opening is formed in said upper ferrite magnetic film above a planar coil terminal portion and an external electrode conductive with said coil terminal portion through said opening is formed on said upper ferrite magnetic film, wherein the planar coil is composed of a Cu conductor and the thickness of the planar coil is 10 $\mu$m or more to 100 $\mu$m or less, an upper ferrite magnetic film is baked at a temperature of 900° C. or more to 1050° C. or less in the atmosphere of less than 1 vol. % in oxygen concentration after said upper ferrite magnetic film is applied.

15. A surface mounting type planar magnetic device wherein a lower ferrite magnetic film is formed on a substrate; a planar coil is formed on said lower ferrite magnetic film; an upper ferrite magnetic film having an opening above a terminal portion of said planar coil is formed; and an external electrode conductive with said planar coil terminal portion is formed, wherein the planar coil is composed of a Cu conductor and the thickness of the planar coil is 10 $\mu$m or more to 100 $\mu$m or less, wherein the planar coil is composed of the Cu conductor formed by electro plating with two-layered film comprising a film composed of a metal selected from Nb, Ta, Mo and W or alloy constituted of two or more thereof and Cu film as plating foundation.

16. A surface mounting type planar magnetic device wherein a lower ferrite magnetic film is formed on a substrate; a planar coil is formed on said lower ferrite magnetic film; an upper ferrite magnetic film having an opening above a terminal portion of said planar coil is formed; and an external electrode conductive with said planar coil terminal portion is formed, wherein the planar coil is composed of a Cu conductor and the thickness of the planar coil is 10 $\mu$m or more to 100 $\mu$m or less, wherein average composition of the upper ferrite magnetic film and the lower ferrite magnetic film is $Fe_2O_3$: 40 to 50 mol %, ZnO: 15 to 35 mol %, CuO: 0 to 20 mol %, $Bi_2O_3$: 0 to 10 mol % while remainder thereof is composed of NiO and unavoidable impurity.

17. A production method of a surface mounting type planar magnetic device wherein upon production of a surface mounting type planar magnetic device wherein a lower ferrite magnetic film is formed on a substrate; a planar coil is formed on said lower ferrite magnetic film; an upper ferrite magnetic film having an opening above a terminal portion of said planar coil is formed; and an external electrode conductive with said planar coil terminal portion is formed, wherein the planar coil is composed of a Cu conductor and the thickness of the planar coil is 10 $\mu$m or more to 100 $\mu$m or less, a planar coil terminal is subjected to surface treatment prior to coupling of a planar coil terminal portion and an external electrode.

18. A production method of a surface mounting type planar magnetic device wherein upon production of a surface mounting type planar magnetic device wherein a lower ferrite magnetic film is formed on a substrate; a planar coil is formed on said lower ferrite magnetic film; an upper ferrite magnetic film having an opening above a terminal portion of said planar coil is formed; and an external electrode conductive with said planar coil terminal portion is formed, wherein the planar coil is composed of a Cu conductor and the thickness of the planar coil is 10 $\mu$m or more to 100 $\mu$m or less, an upper ferrite magnetic film is baked at a temperature of 900° C. or more to 1050° C. or less in the atmosphere of less than 1 vol. % in oxygen concentration after said upper ferrite magnetic film is applied.

19. A surface mounting type planar magnetic device wherein a lower ferrite magnetic film is formed on a substrate; a planar coil is formed on said lower ferrite magnetic film; an upper ferrite magnetic film having an opening above a terminal portion of said planar coil is formed; and an external electrode conductive with said planar coil terminal portion is formed wherein the planar coil is composed of a Cu conductor and the thickness of the planar coil is 10 μm or more to 100 μm or less.

20. A surface mounting type planar magnetic device according to claim 19 wherein Si substrate or alumina ($Al_2O_3$) substrate is used as material of the substrate.

21. A surface mounting type planar magnetic device according to claim 19 wherein the concentration of CuO of a layer contacting the substrate of the lower ferrite magnetic film is not more than 5 mol % while the concentration of CuO of other portion than the layer contacting the substrate is more than 5 mol %.

22. A surface mounting type planar magnetic device according to claim 19 wherein a number of cracks are formed at least on a side not contacting the substrate of the lower ferrite magnetic film while an average of diameters of circles converted from areas surrounded by the cracks is not more than 100 μm.

23. A surface mounting type planar magnetic device according to claim 19 wherein a sectional shape of the planar coil is of forward taper.

24. A surface mounting type planar magnetic device according to claim 19, wherein the thickness of the planar coil is 40 μm or more to 100 μm or less.

25. A surface mounting type planar magnetic device according to claim 19 wherein the planar coil is a spiral coil or a combination of plural spiral coils connected in series.

26. A surface mounting type planar magnetic device according to claim 19 wherein the sectional shape of the planar coil is of forward taper.

27. A surface mounting type planar magnetic device according to claim 19 wherein a coating film composed of $SiN_x$ ($1 \leqq x \leqq 1.5$), $AlN_y$ ($0.8 \leqq y \leqq 1.2$), $Al_2O_3$ or multiple layer constituted thereof in the thickness of 0.1 μm or more to 10 μm or less on the surface of the planar coil excluding a top face of the terminal.

28. A surface mounting type planar magnetic device according to claim 19 wherein the thickness of the lower ferrite magnetic film is 10 μm or more to 100 μm or less.

29. A surface mounting type planar magnetic device according to claim 19 wherein the opening is inside by 50 μm or more to 200 μm or less of the periphery of the planar coil terminal portion while the area of a contact portion in which the coil terminal portion of the opening is in contact with the external electrode is 100 $\mu m^2$ or more.

30. A surface mounting type planar magnetic device according to claim 19 wherein the external electrode is connected to the coil terminal portion by treating conductor paste composed of mainly a metal on an alloy of one or more selected from a group of Ni, Pd, Pt, Ag, Au or soldering paste composed of mainly Sn, disposed on the upper ferrite magnetic film by heat treatment.

31. A surface mounting type planar magnetic device according to claim 19 wherein a metal cap is mounted on the external electrode formed on the upper ferrite magnetic film and connected to the coil terminal portion by heat treatment.

32. A surface mounting type planar magnetic device according to claim 19 wherein the external electrode is formed so as to be in contact with a side or two sides of a device end portion.

* * * * *